US005636533A

United States Patent [19]

Hunneke et al.

[11] Patent Number: 5,636,533

[45] Date of Patent: Jun. 10, 1997

[54] COMPOSITE FABRIC WITH INTEGRAL THERMAL LAYER

[75] Inventors: Fred E. Hunneke; Ulrich Marker, both of Kinston, N.C.

[73] Assignee: Domestic Fabrics Corporation, Kinston, N.C.

[21] Appl. No.: 614,368

[22] Filed: Mar. 12, 1996

[51] Int. Cl.[6] ..... D04B 1/00

[52] U.S. Cl. ..... 66/196; 66/198; 66/200

[58] Field of Search ..... 66/190, 196, 198, 66/200, 202

[56] References Cited

U.S. PATENT DOCUMENTS

| | | | |
|---|---|---|---|
| 3,568,475 | 3/1971 | Philip | 66/200 X |
| 4,797,311 | 1/1989 | Kemp | 66/200 X |
| 5,119,644 | 6/1992 | Strauss et al. | 66/198 |
| 5,373,713 | 12/1994 | Miller . | |

*Primary Examiner*—John J. Calvert

*Attorney, Agent, or Firm*—Rhodes, Coats & Bennett, LLP

[57] ABSTRACT

A composite fabric includes inner and outer knitted layers which are joined by interlock stitches at predetermined intervals to form a composite fabric. The composite fabric 10 is make on a circular knitting machine having cylinder and dial needles by feeding alternating sets of the yarns to the cylinder and dial needs. The cylinder needles form an outer layer of the fabric by knitting a first set of yarns while the dial needles form the inner layer of the fabric by knitting the second set of yarns. During the knitting process, interlock stitches are formed in every course of alternating sets of wales. The interlock stitches are formed in a first set of alternating wales for a predetermined number of courses then switch to a second set of alternating wales for another predetermined number of courses. The alternating of the interlock stitches with respect to the wales of fabric occurs every predetermined number of wales throughout the length of the fabric to produce a series of air pockets arranged in a checkerboard pattern on the inner layer of the fabric. This process results in the production of a composite fabric having a flat outer layer and a thermal inner layer having inherent insulating properties.

7 Claims, 4 Drawing Sheets

COMPOSITE FABRIC WITH INTEGRAL THERMAL LAYER

FIELD OF THE INVENTION

The present inventions relates generally to the field of knitted fabrics and methods for constructing knitted fabrics. More particularly, the present invention relates to a composite fabric having inherent thermal properties.

BACKGROUND OF THE INVENTION

Jersey knit fabrics are commonly used in the construction of athletic wear, such as sweatshirts and T-shirts. Often times it is desirable to have a jersey knit fabric with a thermal lining. For example, a sweatshirt with thermal lining is desirable for those who engage in athletic activities during cool weather periods. Thermal-lined jersey knit fabrics are conventionally constructed by bonding or laminating two separate fabrics—namely a jersey fabric and a thermal fabric. Consequently, manufacturers of thermal-lined clothing must separately order a jersey fabric and a thermal fabric and have these fabrics shipped to a laminator for bonding. This process greatly increases the cost of the fabric as compared to conventional fleeced goods.

SUMMARY OF THE INVENTION

The present invention relates to a composite fabric having an outer layer comprising a conventional jersey knit construction and an inner thermal layer characterized by alternating air pockets and ribs arranged in staggered rows. The jersey knit and thermal layers are produced on a circular knitting machine. The cylinder needles produce the outer layer of the fabric and the dial needles form the inner thermal layer. The inner and outer layers are interconnected at intervals by an interlock stitch or tuck stitch to hold the two layers together. The vertical tuck stitches are formed in every other wale in each course for a predetermined number of courses. After a predetermined number of courses is formed, the formation of the tuck stitches shifts one wale and continues for a predetermined number of courses. The formation of tuck stitches continues to shift back and forth after every predetermined number of courses to form staggered rows of ribs and air pockets on the inner layer of the double-knit fabric. The air pockets formed in this manner provide inherent insulating qualities.

The present invention provides a relatively simple knit construction having a thermal layer which is formed simultaneously as part of a thermal knit fabric construction. The present invention eliminates the need to bond or laminate two separate fabrics as is common practice in the industry today. Consequently, the present invention should significantly reduce material, labor, and shipping costs associated with the production of thermal-lined knit goods.

DESCRIPTION OF THE PREFERRED EMBODIMENT

Figure 1:
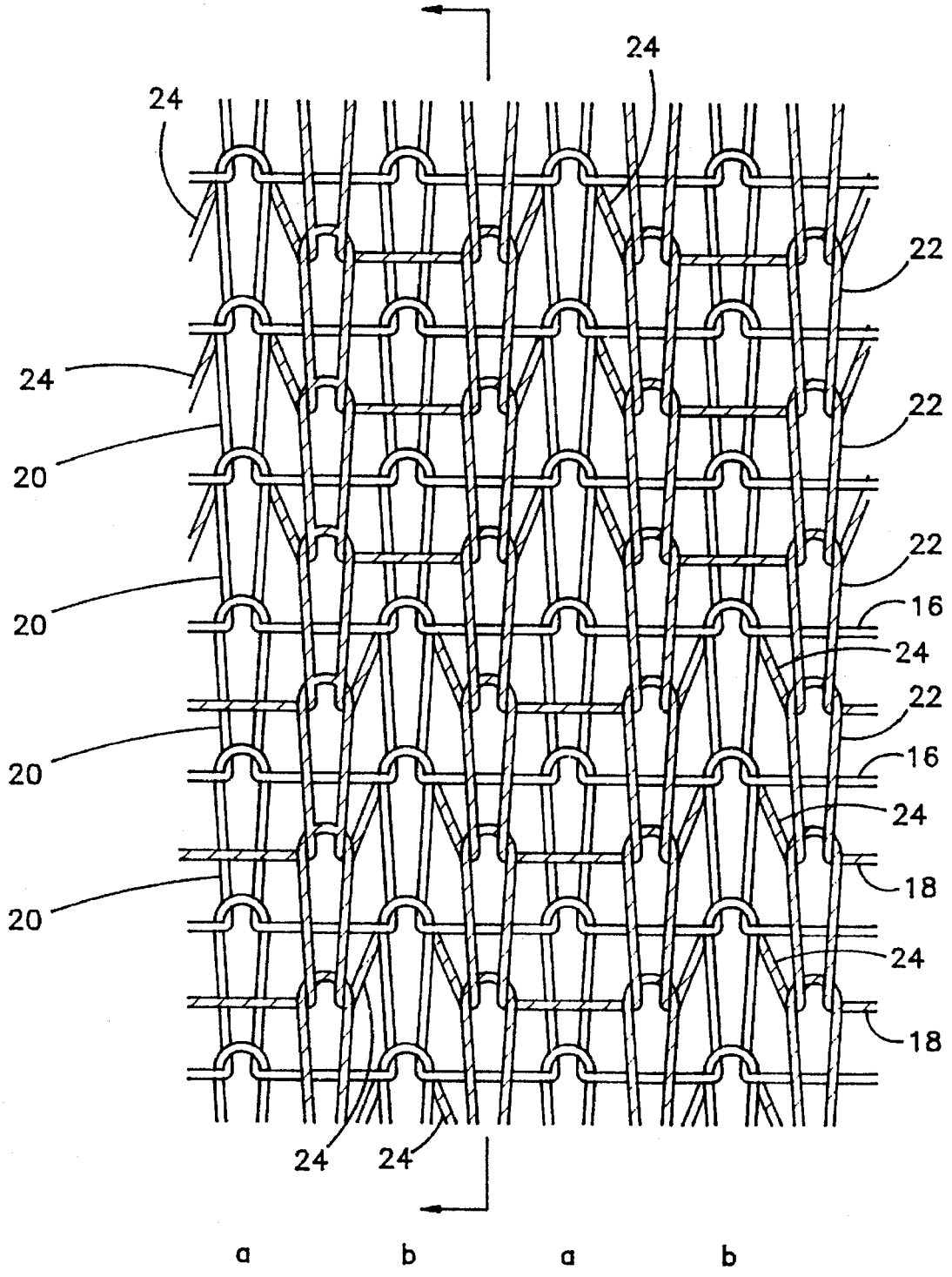
FIG. 1 is a view of the composite fabric as seen from the inner layer.

Referring now to the drawings, the composite fabric 10 of the present invention and the method for making the composite fabric 10 will be described in detail. The composite fabric 10, shown in FIGS. 1 and 2, comprises an outer knitted web or layer 12 and an inner knitted web or layer 14 held together by interlock or tuck stitches 24 at predetermined intervals to form the composite fabric 10. Each layer comprises a plurality of yarns 16 and 18 which may be made of any natural or synthetic fibers, or a combination thereof. The yarns 18 of the inner web 14 are shown shaded to distinguish them from the yarns 16 of the outer web 12. The outer web 12 comprises a conventional jersey knit construction while the inner web 14 comprises a thermal construction characterized by alternating air pockets and ribs arranged in staggered rows.

The composite fabric 10 of the present invention is produced on a conventional circular knitting machine having cylinder needles and dial needles. The inner layer 12 and outer layer 14 are knitted simultaneously by respective sets of needles. The composite fabric is tubular and the layers 12 and 14 are separate except at points where interlocking tuck stitches 24 are formed to hold the two layers together. The cylinder needles knit the outer layer 12 of the composite fabric 10 and the dial needles knit the inner layer 14.

Figure 4:
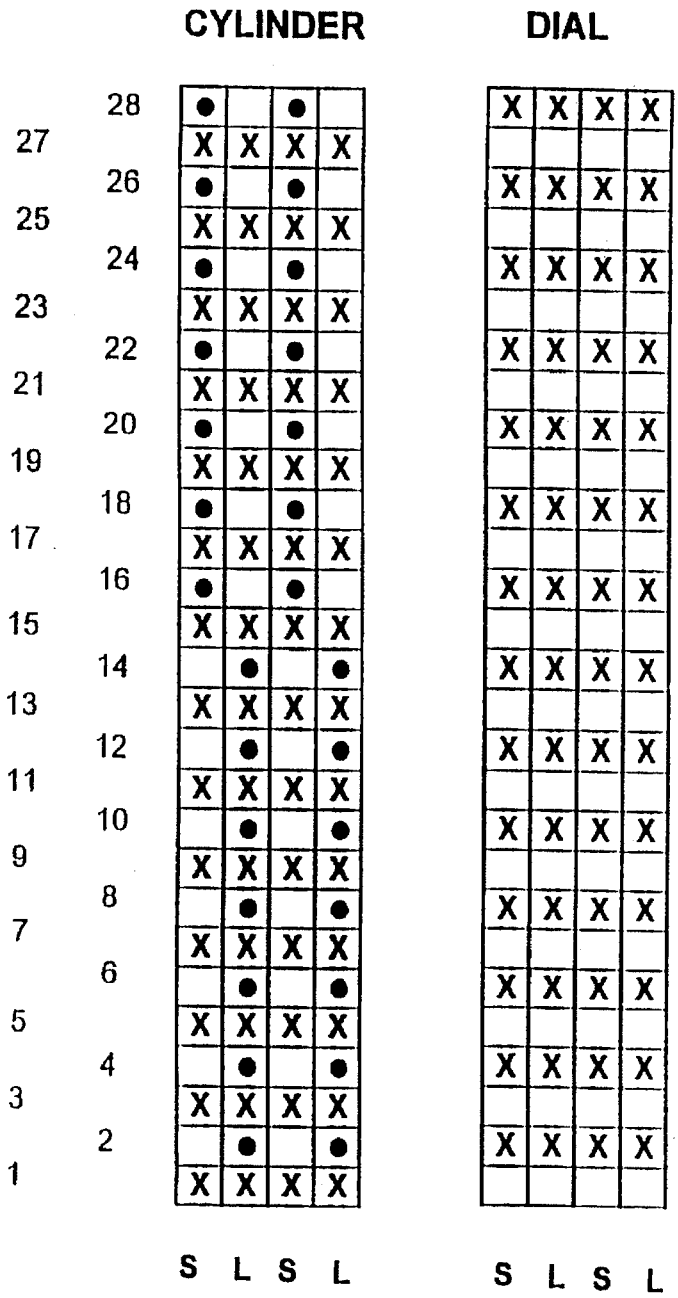
FIG. 4 is a knitting chart for the fabric illustrated in FIG. 1.
Figure 4:
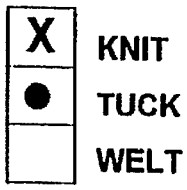

FIG. 4 is a chart of the knitting pattern for the composite fabric 10 shown in FIG. 1. Each row of the chart represents a separate feed. Each column represents the position of either a cylinder or dial needle as the cylinder or dial is rotated past each feed. The knit pattern shown in FIG. 4 repeats after every 28 feeds. The yarns 16 of the outer layer are fed to the cylinder needles at every odd-numbered feed while the yarns 18 of the inner layer are fed to the dial needles at even-numbered feeds. The cylinder needles thus form the outer layer 12 of the composite fabric 10. The dial needles form the inner layer 14 of the composite fabric 10. At predetermined intervals, the cylinder and dial needles are actuated simultaneously to form an interlocking stitch 24 to hold the outer and inner layers 12 and 14 together as will be described in greater detail below.

Referring back to FIG. 1, the outer layer 12 comprises a plurality of integral loops 20 extending in courses and wales across the fabric 10 to form a plain jersey knit construction. The inner layer 14 comprises a plurality of similarly formed loops 22 also extending in courses across the inner layer 14 of the composite fabric 10. The outer and inner layers 12 and 14 are secured together at spaced intervals throughout the fabric by knitting the loop 22 of the inner layer 14 through a loop 20 of the outer layer 12 to form an interlocking or tuck stitch 24. Using the yarns 18 of the inner layer to form the interlock stitches 24 is preferred in order to maintain a uniform or flat appearance on the outer layer 12. The interlocking or tuck stitch 24 is formed by raising the cylinder needle to the tuck position simultaneously with the actuation of the corresponding dial needle. Consequently, the cylinder needle engages the yarn 18 of the inner layer 14 without casting off the yarn 16 of the outer layer 12. Thus, a interlocking or tuck stitch 24 is drawn through a loop 20 of the outer layer 12 thereby tying the two webs 12 and 14 together.

Figure 2:
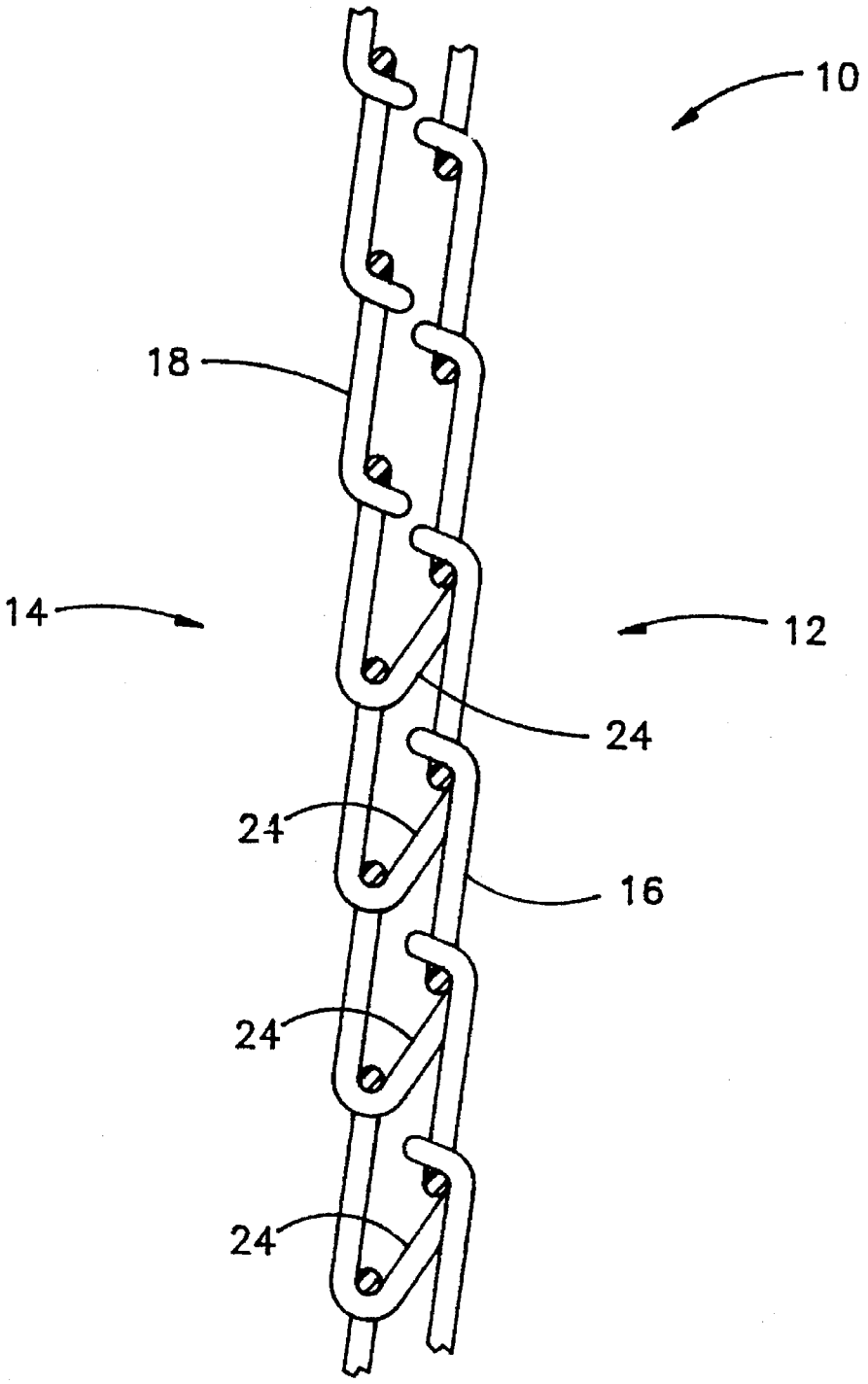
FIG. 2 is a sectional view of the composite fabric.

The interlocking or tuck stitches 24 are formed on every course of the outer and inner layers 12 and 14 on every other wale. The tuck stitches 24 are formed on alternating sets of wales designated as a and b which changes every seven courses. Thus, as shown in FIG. 2, the tuck stitches 24 are formed on wales a using the long needles (L) on the cylinder for seven courses and then on wales b using the short needles (S) of the cylinder for the next seven courses. The wales containing the tuck stitches 24 alternate every seven courses throughout the entire length of the composite fabric 10.

Figure 3:
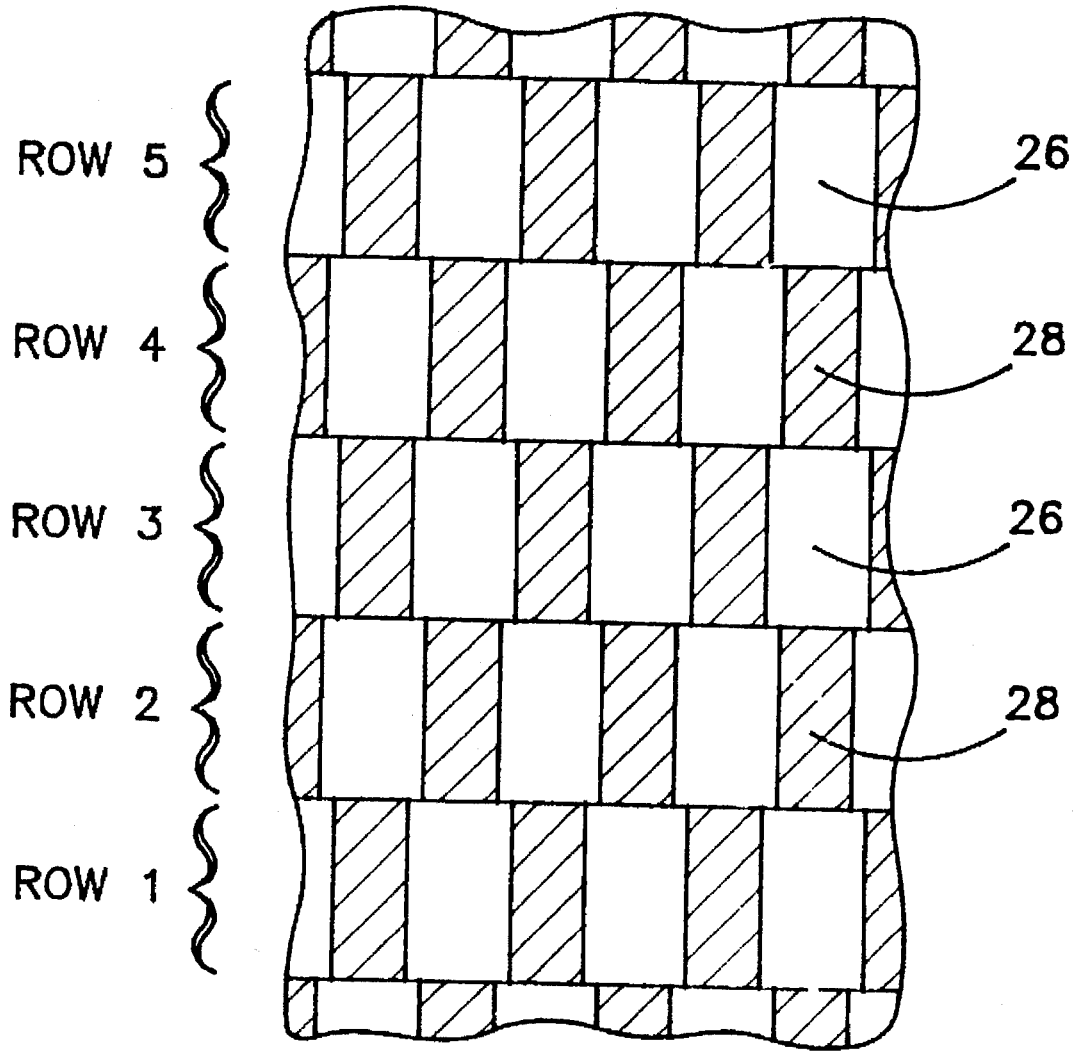
FIG. 3 is a schematic illustration of the inner layer of the composite fabric.

Referring now to FIG. 3, the presence of the tuck stitches 24 in alternating sets of wales creates of air pockets 26 on the inner surface of the composite fabric 10. The tuck stitches 24 pull the adjacent wales on opposing sides of the tuck stitch 24 together while the wales without a tuck stitch between them are pulled apart. This produces a checkerboard pattern having distinct rows and columns on the inner surface of the composite fabric 10 which is shown schematically in FIG. 3. More particularly, the wales of the inner layer 14 which are pulled together form short checks 26 seven courses in length and two wales wide which are laterally spaced across the width of the fabric 10. The checks 26 are separated by air pockets 28, also seven courses in length and two wales wide. Looking at the inner surface of the garment, the alternating checks 26 and air pockets 28 are arranged in rows which are seven courses in length and columns approximately 2 wales wide. The term "row" as used herein means a horizontal band of checks 26 and pockets 28. The term "column" means a vertical band of checks 26 and air pockets 28. Each row of alternating checks 26 and pockets 28 is staggered with respect to the adjacent rows. The checks 26 overlap slightly at the corners. The voids or pockets 28 provided on the inner layer enable the entrapment of air to form an insulating or thermal layer. When worn on the body, the air pockets 28 on the inner layer 14 of the fabric 10 provide an insulating effect which is greater than conventional jersey knit fabrics of similar weight.

The type of yarns 16 and 18 used on the outer and inner layers 12 and 14 respectively are not a material aspect of the present invention. The yarns 16 and 18 on the outer and inner layers may be of similar type and size, or may be of different types or sizes. For example, the composite fabric 10 may be made entirely of cotton, polycotton or polyester fibers. The preferred yarn size is in the range of 16 to 22 denier. There may be instances where different types or sizes of yarns may be used for the inner and outer layers respectively. One useful embodiment employs hydrophobic yarns, such as polyester yarns, for the inner layer 14 and hydrophilic yarns, such as cotton yarns, for the outer layer 12. In this type of fabric, perspiration from the body is transferred by capillary action to the outer layer 12 of the fabric 10 and absorbed. This capillary action keeps the inner layer 14, which lies against the body, dry thereby improving the insulating quality of the fabric 10.

The composite fabric of the present invention is especially useful for making polo sweatshirts and the like. Because the composite fabric 10 has inherent thermal properties not found in conventional jersey knit fabrics, it can be used as a substitute for separate jersey knit and jersey layers which are bonded together in conventional fabrics. The composite fabric 10 of the present invention costs the same to produce as a conventional double-knit jersey fabric without a thermal lining. Thus, the present invention should greatly reduce both material and labor costs associated with the production of thermal lined sweatshirts.

What is claimed is:

1. A composite fabric comprising:

a) an outer layer made from a first set of yarns knitted to form a series of loops arranged in courses and wales;

b) an inner layer made from a second set of yarns knitted to form a series of loops arranged in courses and wales;

c) a plurality of tuck stitches joining said outer layer and said inner layer, said tuck stitches comprising yarns of said inner layer drawn through loops of said outer layer at predetermined intervals; and d) wherein the tuck stitches are formed in sets comprising a series of tuck stitches in consecutive courses along each of said wales, and wherein said sets of consecutive tuck stitches in adjacent wales are staggered with respect to one another; and e) a series of air pockets formed in the inner layer between adjacent wales where no tuck stitches are present, said air pockets being laterally spaced in rows with the air pockets in each row being staggered with respect to the air pockets in the adjacent rows.

2. The composite fabric of claim 1 wherein the yarns of the outer layer are made from a hydrophilic fiber, while the yarns of the inner layer are made from a hydrophobic fiber.

3. The composite fabric of claim 1 wherein said yarn is a multi-strand yarn.

4. A method for making a composite fabric with a thermal layer comprising:

a) forming outer and inner layers by knitting alternating sets of yarns, each layer comprising a series of loops arranged in courses and wales;

b) joining said outer and inner layers by forming tuck stitches, said tuck stitches comprising yarns of said inner layer drawn through loops of said outer layer at predetermined intervals;

c) forming said tuck stitches in staggered sets comprising a series of tuck stitches in consecutive courses along each of said wales so that said sets of consecutive tuck stitches in adjacent wales are staggered with respect to one another;

d) wherein a series of air pockets are produced in said inner layer between said staggered sets of tuck stitches.

5. The method for making a composite fabric according to claim 4 wherein a hydrophilic yarn is used to knit the outer layer and a hydrophobic yarn is used to knit the inner layer.

6. A method for making a composite fabric with a thermal layer on a circular knitting machine having cylinder and dial needles comprising:

a) feeding a plurality of yarns to the cylinder and dial needles of the circular knitting machine, such that a first set of yarns is fed to the cylinder needles and a second set of yarns is fed to the dial needles;

b) forming an outer layer of the composite fabric by knitting said first set of yarns with said cylinder needles to form a series of loops arranged in courses and wales;

c) forming an inner layer of said composite fabric by knitting the second set of yarns to form a series of loops arranged in courses and wales;

d) forming a series of tuck stitches in each wale that extend through a plurality of consecutive courses to bind the inner and outer layers together;

e) staggering the series of tuck stitches in the adjacent wales with respect to one another to form a series of air pockets in the inner layer of said composite fabric, said air pockets being arranged in checkerboard fashion in rows with the air pockets in each row being staggered with respect to the air pocket in the adjacent rows.

7. The method for making a composite fabric according to claim 6 wherein a hydrophilic yarn is used to knit the outer layer and a hydrophobic yarn is used to knit the inner layer.

* * * * *